US005505297A

United States Patent [19]

Myers

[11] Patent Number: 5,505,297

[45] Date of Patent: Apr. 9, 1996

[54] GARMENT BAG CONSTRUCTION TO MINIMIZE WRINKLING

[75] Inventor: Jay E. Myers, Newport Beach, Calif.

[73] Assignee: Andiamo, Inc., Fountain Valley, Calif.

[21] Appl. No.: 367,755

[22] Filed: Dec. 30, 1994

Related U.S. Application Data

[63] Continuation of Ser. No. 17,039, Feb. 12, 1993, abandoned.

[51] Int. Cl.[6] ..... A45C 5/12; A45C 13/30

[52] U.S. Cl. ..... 206/279; 206/280; 206/287.1; 206/292; 190/36; 190/125; 190/127

[58] Field of Search ..... 190/36, 108, 125, 190/127, 122, 12 A; 206/279, 282, 287, 227.1, 292, 280

[56] References Cited

U.S. PATENT DOCUMENTS

| | | | |
|---|---|---|---|
| D. 267,677 | 1/1983 | Pelavin | 190/108 X |
| 273,502 | 3/1888 | Franklin . | |
| 1,438,737 | 12/1922 | Witbeck | 190/36 X |
| 1,644,367 | 10/1927 | Cabral . | |
| 1,677,146 | 7/1928 | Lobner . | |
| 1,701,192 | 2/1929 | Rogers . | |
| 1,831,822 | 11/1931 | Parisette | 206/292 X |
| 1,988,530 | 1/1935 | Wheary | 206/292 X |
| 2,002,638 | 5/1935 | Lee et al. | 206/292 X |
| 2,119,603 | 6/1938 | Schwab . | |
| 2,157,833 | 5/1939 | Plotkin | 190/127 |
| 2,269,252 | 1/1942 | Chesnut | 206/292 |
| 2,270,290 | 1/1942 | Graham . | |
| 2,362,807 | 11/1944 | Dresner | 206/292 X |
| 2,384,332 | 9/1945 | Nicholas . | |
| 2,430,030 | 11/1947 | Reiss . | |
| 2,446,733 | 8/1948 | Abbe | 206/292 X |
| 2,580,281 | 12/1951 | Burton, Jr. | 206/292 X |
| 2,581,099 | 1/1952 | Guffey . | |
| 2,660,819 | 12/1953 | Cox . | |
| 2,709,861 | 6/1955 | Reed . | |
| 2,710,082 | 6/1955 | Ruge | 206/292 X |
| 2,717,671 | 9/1955 | Arnold et al. | 206/287.1 X |
| 3,060,603 | 10/1962 | Blanchard et al. . | |
| 3,104,740 | 9/1963 | Koffler | 206/287.1 X |
| 3,221,848 | 12/1965 | O'Neil | 206/287 X |
| 3,448,839 | 6/1969 | Lugash | 206/287 |
| 3,512,621 | 5/1970 | Teetor | 206/287 |
| 3,542,170 | 11/1970 | Bialo | 206/279 |
| 3,944,032 | 3/1976 | Samhammer et al. | 206/292 |
| 4,206,835 | 6/1980 | Shapiro | 206/287 X |
| 4,436,189 | 3/1984 | Baum | 190/108 |
| 4,544,051 | 10/1985 | Saltz | 190/127 X |
| 4,562,952 | 1/1986 | Chinman | 229/87 |
| 4,598,803 | 7/1986 | Ghiassi | 206/287.1 X |
| 4,662,513 | 5/1987 | King et al. | 206/287.1 |

(List continued on next page.)

FOREIGN PATENT DOCUMENTS

| | | | |
|---|---|---|---|
| 2508288 | 12/1982 | France | 190/125 |
| 4314401 | 11/1992 | Japan | 190/127 |
| 664476 | 3/1988 | Switzerland | 190/108 |
| 22432 | 7/1912 | United Kingdom | 190/36 |

*Primary Examiner*—Sue A. Weaver
*Attorney, Agent, or Firm*—Poms, Smith, Lande & Rose

[57] ABSTRACT

A garment bag of the type having an elongate body substantially formed of flexible fabric or sheet material, and defining a cavity with a hanger support at the top for receiving hanging clothes on hangers. The bag folds double on itself for transport, and includes a pair of rigid wall portions which when the bag is folded double on itself are urged forcefully together. These rigid wall portions substantially immobilize the clothing items therebetween to greatly reduce creasing and wrinkling of the clothing items which would otherwise result from their shifting about in transit. The garment bag also includes features preserving the efforts of careful packing during folding and unfolding of the bag to further reduce clothes wrinkling. Also, the garment bag includes a specially configured toiletries kit which by its shape and placement in the folded bag further contributes to a reduction of clothes wrinkling. The garment bag is also self-supporting in its transport conditions so that it is more convenient to carry by hand.

7 Claims, 3 Drawing Sheets

U.S. PATENT DOCUMENTS

| | | | |
|---|---|---|---|
| 4,693,368 | 9/1987 | King et al. | 206/287.1 |
| 4,727,987 | 3/1988 | Zezza | 190/36 X |
| 4,753,342 | 6/1988 | Pulichino, Jr. et al. | 206/287.1 X |
| 4,854,602 | 8/1989 | Takeuchi | 190/122 X |
| 4,881,684 | 11/1989 | Chinman | 229/87 |
| 4,998,603 | 3/1991 | Nordstrom | 190/18 A |
| 5,010,988 | 4/1991 | Brown | 190/127 X |
| 5,054,589 | 10/1991 | Bomes et al. | 190/18 A |
| 5,150,776 | 9/1992 | Rebenack | 190/36 X |
| 5,195,620 | 3/1993 | Tate | 190/36 |
| 5,255,766 | 10/1993 | Deconinck | 190/36 |
| 5,259,539 | 11/1993 | Brotman | 190/127 X |

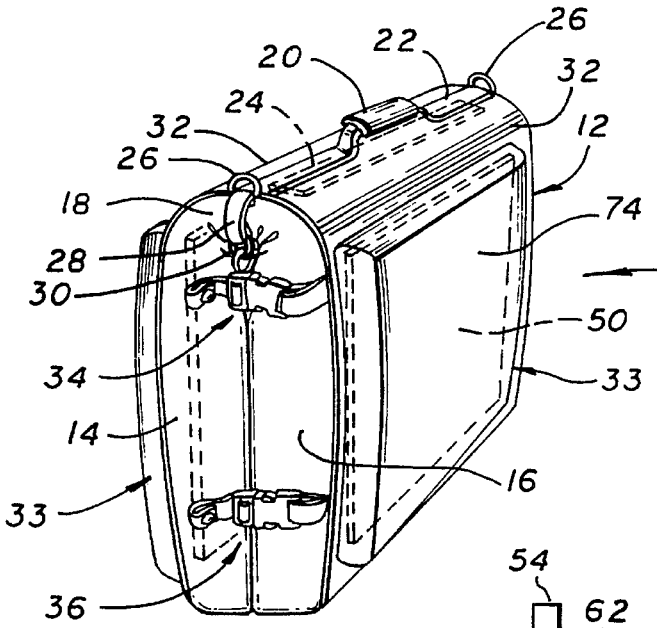
FIG. 1
FIG. 2
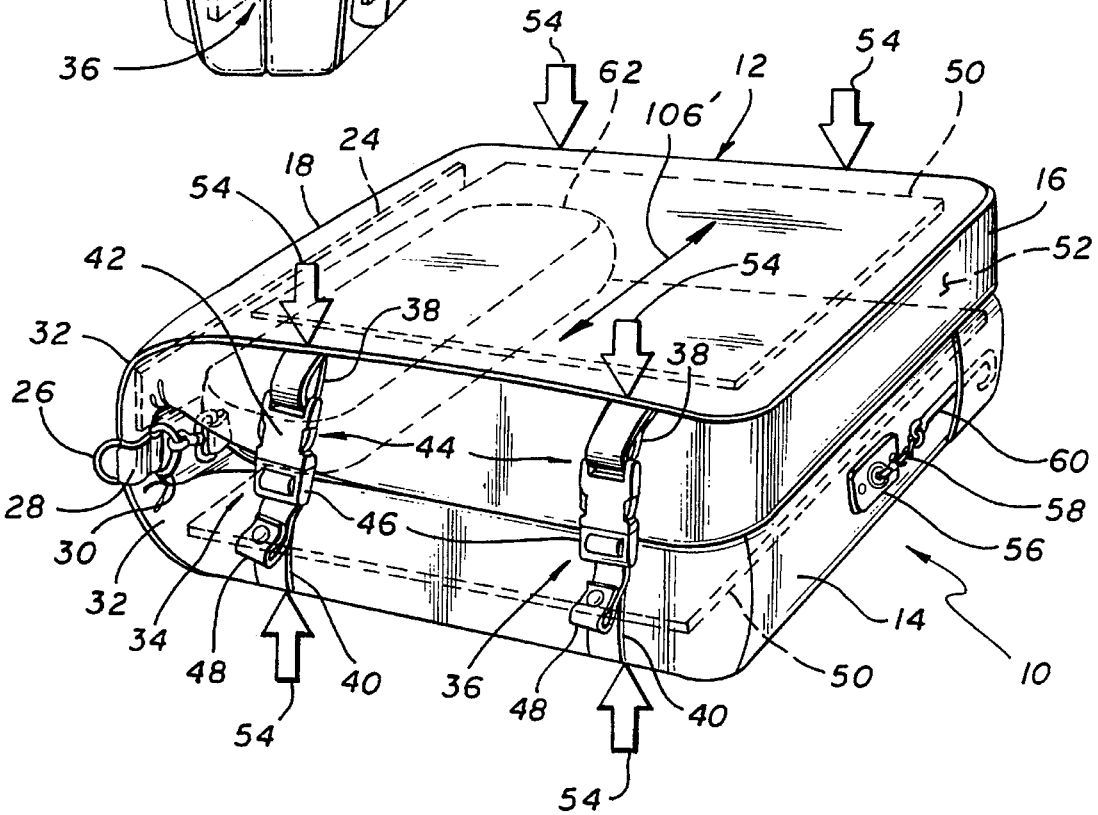
FIG. 4
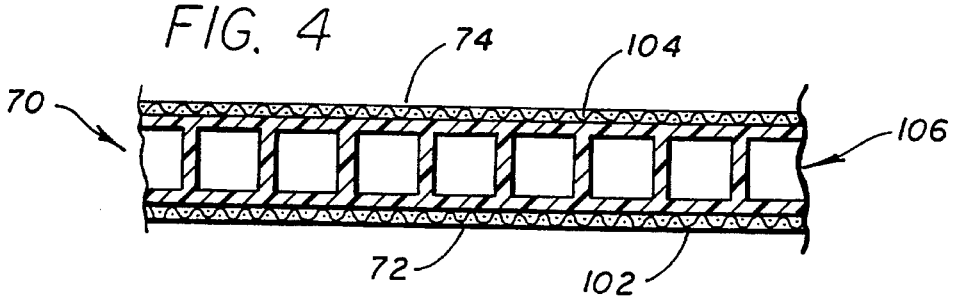

10
12
40
46
48
60
80
76
100
72
50
70
80
94'
94
94'
88
68
88
76
98
40
46
48
30
78
24
30
76
96'
96
98
96'
96
98
42
38
4
4
84
38
86
86
42
82
42

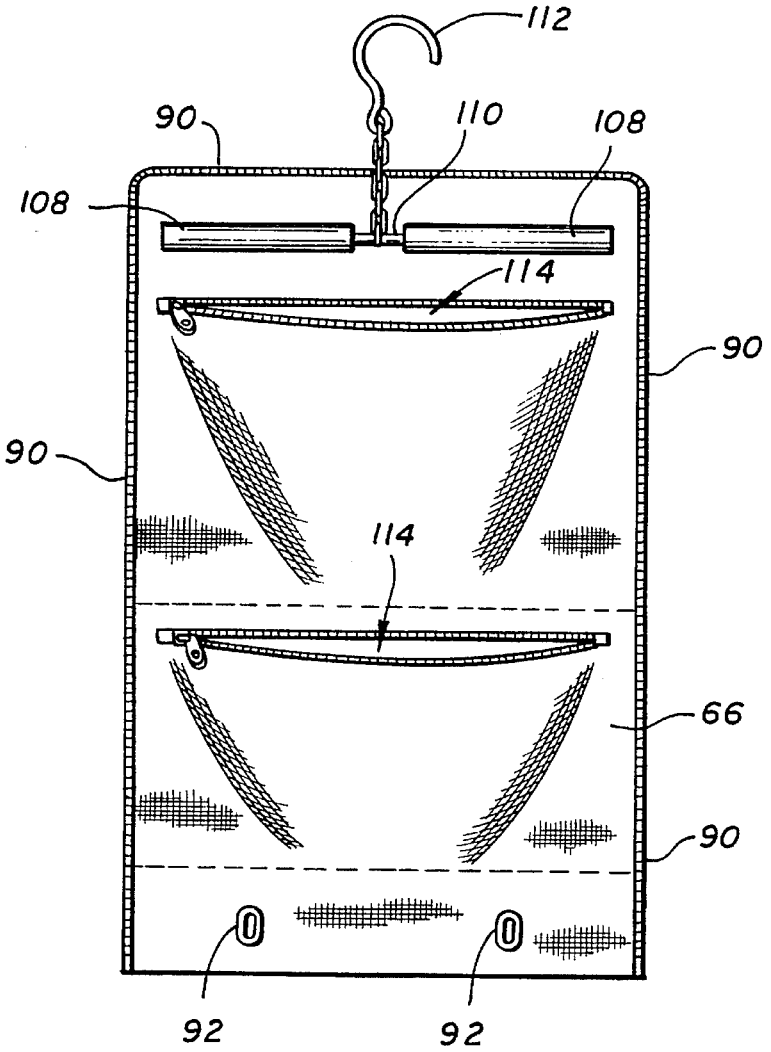
FIG. 5
FIG. 7
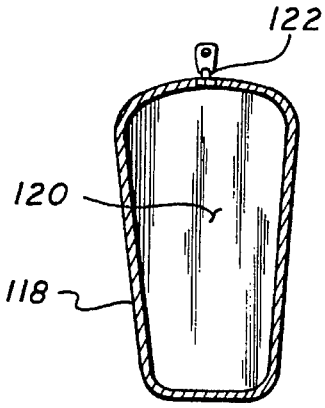
FIG. 6
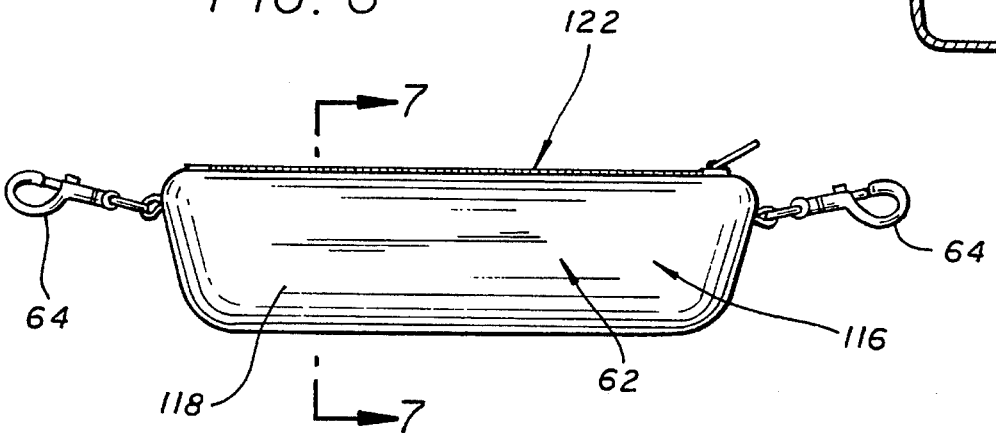

GARMENT BAG CONSTRUCTION TO MINIMIZE WRINKLING

This is a continuation of application Ser. No. 08/017,039, filed on Feb. 12, 1993, now abandoned.

BACKGROUND OF THE INVENTION

1. Field of the Invention

The present invention relates to garment bags. More particularly, the present invention relates to garment bags of the type having flexible walls of fabric or plastic sheeting, for example, and which at one end thereof provide a hook by which the bag and its contents may be hung. The hanging bag is able to receive hanging clothes on hangers, as well as other possessions of a traveler. For transportation, such garment bags fold on themselves so that ends of the bag are congruent or confront one another, and the hanging clothing items therein are transported in a folded condition. For example, the bag may fold generally in half or in thirds so that the height of the bag in its folded condition is convenient for a person to carry. Generally a garment bag of the indicated type includes a handle or strap attached outwardly of a fold in the bag so that a traveler may conveniently carry the bag and its contents. Also, generally a strap or pair of straps connects the congruent ends of the bag to retain the bag in its folded condition for carrying. A bag which folds more than once will generally include additional straps securing the additional folded portion of the bag in a folded position.

2. Description of the Related Art

Suitcases or valises having rigid walls or a rigid frame with flexible side walls are well known. When such a suitcase is carefully packed snugly with clothes, the clothing items will not shift about very much during transportation, and are much less likely to be creased or wrinkled very much by the random uncontrolled movements of the bag in transport. However, when such a suitcase is not snugly packed, the clothing items therein will shift about in transportation and will arrive at their destination badly wrinkled. Unfortunately, a traveler does not always have a suitcase of exactly the size needed for snug packing. Because rigid-walled and rigid-framed suitcases are not expansible to match the size needed, a traveler using such a case will use a suitcase of a size sufficient to insure that all the desired clothing and other items can be packed into the case. Such a case will generally be somewhat larger than needed, will be somewhat loosely packed, and the traveler will consequently suffer with wrinkled clothes which have shifted about within the suitcase during transit.

Moreover, because of their convenience in packing, transportation, and use, garment bags having flexible walls have become increasingly popular. These bags usually incorporate an external hook by which the bag and its contents may be hung for packing and access. Internally, these bags include a hanger support structure by which clothes on hangers may be suspended within the bag. While these garment bags generally include a stiffened spine area where the bag folds and to which the handle and shoulder strap attaches, as well as a "boxing" or stiffening in the area of the internal hanger support structure, these conventional garment bags are for the most part fabricated of flexible sheet or fabric and are flexible, or are not shape-retaining.

As mentioned above, this conventional type of garment bag usually provides for the bag to be secured and carried in a folded condition. In addition, these bags with their flexible walls are somewhat expansible to accommodate the needs of the traveler. That is, the bag can accommodate a greater packing of clothes and other articles therein simply by becoming fatter. Conventional garment bags also include a plurality of internal and external pockets which allow the bag to be soft-packed for best use of the available volume.

Unfortunately, the advantages provided by the flexibility of conventional garment bags also results in a great increase in the problem of clothes in the bag being creased and wrinkled. As discussed above, this clothes wrinkling problem is believed to originate with two sources. The first of these sources is simply careless packing. In this regard, creases which are introduced by careless packing are not attributable to any particular suitcase or garment bag design. The design of a particular garment bag can only contribute to the alleviation of this first aspect of clothes wrinkling by being convenient and easy to use.

Secondly, flexible garment bags contribute to the wrinkling of clothes therein in two related ways. On the one hand, the flexibility of the bag itself allows the clothing items in the bag to be flexed and wrinkled as the bag is moved about in transit. Because the garment bag itself is flexible, it may be again be folded double, bunched up, rolled up, or otherwise forced out of its intended configuration as it is handled along with other items of luggage traveling through an airport, or to or from an aircraft, for example. Of course, the clothing items in the bag are subjected to quite a bit of bunching and wrinkling as the bag is subjected to these distortions from its intended shape.

On the other hand, and in part because of the flexibility of the garment bag, the clothing items therein may not be held securely in place. This aspect of the wrinkling problem also exists with rigid-wall and rigid-framed soft-side suitcases which are not tightly packed. That is, the clothes may be jostled about and shifted within the bag during handling and transport. With a conventional garment bag, it is not possible to prevent the clothing items from being shifted about.

These two factors in conjunction with one another contribute to a creasing and wrinkling problem with conventional garment bags which exceeds even the well known problem with conventional rigid-wall and rigid-frame suitcases.

Nevertheless, because of their convenience, flexible garment bags have become very popular, and are widely used by travelers. This popularity of conventional flexible-wall garment bags may contribute to the large market for travel-sized steam irons.

SUMMARY OF THE INVENTION

In view of the above, the present invention provides a garment bag which in part is flexible, and offers all of the conveniences and advantages of conventional flexible-wall garment bags. On the other hand, a garment bag embodying the present invention is in part rigid, and includes a pair of spaced apart rigid planar wall members which are flexibly connected to in a congruent relative position cooperatively define between them a variable volume into which clothing items may be packed. The rigidity of the wall members in the present context is a relative term. In comparison to the flexible sheet or fabric material from which most of the garment bag is fabricated, these wall members are rigid. However, these wall members may in fact be somewhat flexible, so long as they are generally shape-retaining. The wall members are movable flexibly toward and away from one another to adapt to the volume of clothing which a user wishes to place therebetween. Further, the garment bag includes adjustable structure extending between the pair of wall members to everywhere apply a compressive force on the clothing items therebetween. Because of this compressive force acting on the rigid planar wall members, the clothing items therebetween are substantially immobilized, and cannot be jostled or shifted about due to handling of the bag in transit. Also, due to the rigid wall members cooperating with the remainder of the flexible structure of the garment bag, the bag cannot be distorted, bunched up, rolled up, or again folded double on itself, as can conventional garment bags.

Moreover, the present invention provides a garment bag which includes at least one pair of flexible wall portions cooperatively holding clothing items in place in the bag both during the folding of the bag between its open and closed positions, as well as during handling and transport of the bag. Importantly, these wall portions cooperate with the rigid planar wall members during packing of the garment bag to immobilize clothing items. Conceptually, the rigid planar members might be envisioned as a supportive foundation against which the flexible wall members hug the clothing items to preserve the efforts of careful packing during folding and transport of the garment bag. As a result, the efforts of careful packing of the bag are not lost during the folding of the bag to its transport condition, and the flexible wall members assist in immobilizing the clothing items in the garment bag during transport.

Further, the present inventive garment bag includes an optionally removable elongate and specially shaped or contoured toiletries kit which is disposed across the bag immediately inwardly of the fold thereof to outwardly define a fold-around radius for the clothing items within the bag. Also, the present invention includes a curtain member which closes the opening to the bag, and which is itself provided with a hanging hook and a plurality of pockets for soft packing. Consequently, this curtain member may be opened either to the side to be supported by its own hook while still being secured to the garment bag, to hang downwardly, or may be separated from the remainder of the bag and be hung by its hook. In this way, the curtain member provides convenient access to the contents of the garment bag and its own pockets.

The present inventive garment bag offers several advantages. Chief among these several advantages is the great reduction of creasing and wrinkling realized from the cooperative compression and immobilization of clothing items between the pair of rigid wall portions of a garment bag according to the present invention. That is, during packing of the garment bag, the flexible wall members hug the clothing items against the foundation provided by the rigid planar wall members, and preserve the efforts of careful packing. In other words, the clothing items are preconditioned to endure with little wrinkling the subsequent folding of the garment bag and its transport. When the garment bag is folded on itself to its transport condition, and the rigid planar members are urged toward one another, they further immobilize the clothing items therebetween to greatly reduce creasing and wrinkling of these items in transit.

Also, the partial rigidity of the present garment bag offers increased protection to breakable items, such as hair dryers and curling irons, for example, which may be carried in the bag. Further, the present garment bag includes at least a pair of flexible wall portions which assist in holding clothing items in place both during folding of the bag to its travel position, as well as when the packed bag is unfolded for access to its contents. Thus, the results of careful packing efforts are not lost during the folding and unfolding of the garment bag. Still further, the present garment bag includes as an option, an elongate toiletries kit on the one hand itself urging the packed clothing items toward one of the rigid planar members to precondition these items to fold at a particular place when the garment bag is folded. On the other hand, the toiletries kit defines a rather large fold-around radius for the bag. Thus, the size, shape, and placement of the toiletries kit itself also contributes to the immobilization of clothing items in the garment bag. Finally, the present garment bag includes a removable curtain member which when removed opens a large and convenient opening into the garment bag. This curtain member itself provides additional pockets which may be packed with items for the traveler.

Additionally, the outside pockets of the garment bag, when they are packed with clothing items or other articles, contribute to the support of the rigid planar members, as well as helping to shield these members from possible damage resulting from rough handling of the garment bag.

The above and additional advantages of the present invention will appear from a reading of the following detailed description of a single preferred and exemplary embodiment of the invention, taken in conjunction with the following drawing figures, in which:

BRIEF DESCRIPTION OF THE DRAWINGS

FIG. 1 provides a perspective external view of a garment bag embodying the present invention in its transport configuration;

FIG. 2 provides a perspective external view of the garment bag similar to FIG. 1, but at a larger size than FIG. 1, with the bag placed on its side as it may appear after packing, and with portions of the garment bag omitted or shown in phantom lines to provide a transparent structure better revealing and illustrating internal structural portions of the bag;

FIG. 4 provides a fragmentary cross sectional view taken along line 4—4 of FIG. 3, and viewed in the direction of the arrows;

FIG. 5 is an elevation view of a component part of the garment bag seen in the other drawing figures; and FIGS. 6 and 7, respectively, provide an elevation and a sectional view of a component part of the garment bag seen in the other drawing figures.

DESCRIPTION OF THE PREFERRED EMBODIMENT

Figure 3:
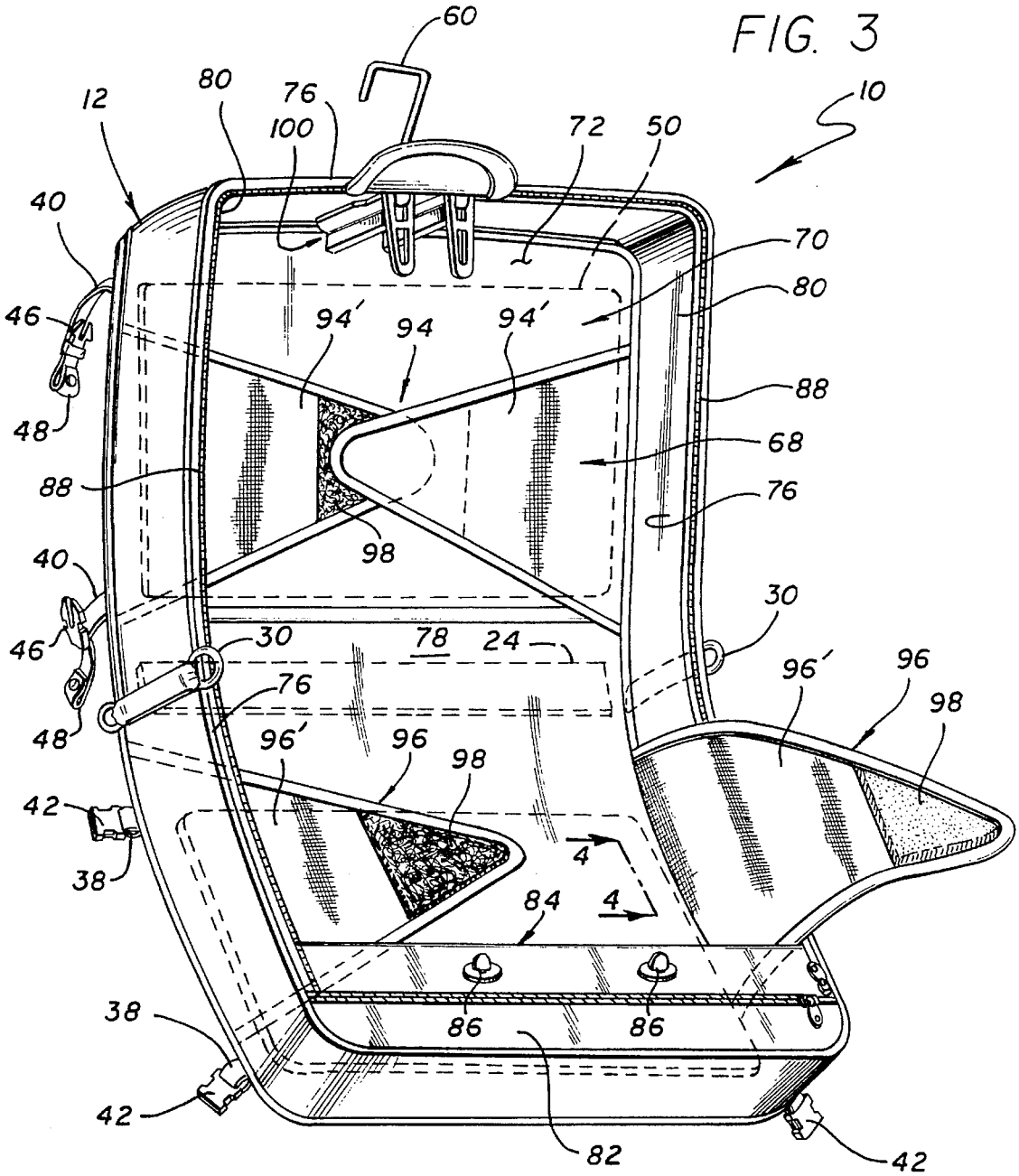
FIG. 3 presents a perspective view of the garment bag in its open or use position as it may appear during packing or use, and also with portions of the bag in phantom lines to better depict the internal structural features of the bag.

FIG. 1 provides an external perspective view of a garment bag 10 embodying the present invention, and which is shown in its transport configuration. The garment bag 10 includes a bipartite body 12, which is mostly fabricated of flexible, durable, and soil-resistant fabric. In the transport configuration of the bag 10, the body is primarily of inverted U-shape, and includes a first and second chambered legs, 14 and 16 respectively, which are connected by a flexible chambered fold portion 18 of the garment bag 10. However, those ordinarily skilled in the pertinent arts will recognize that some garment bags are configured to fold on themselves more than once. While these garment bags when folded are also generally of a U-shape in section, they also include an additional lower portion into which the lower extremities of a long garment such as a dress may hang. This lower portion is generally folded upwardly between the two main portions of the garment bag and secured for travel. This latter type of garment bag may also incorporate the features of the present invention and fully enjoy its advantages also. At the fold portion 18, the housing includes a carrying handle 20. The handle 20 is secured to webbing 22 which outwardly overlies a stiffening spine member (seen in FIG. 2, and referenced with the numeral 24) of the bag 10, although those ordinarily skilled in the pertinent arts will recognize that the handle 20 could be secured to the bag 10 in other ways, and that the spine 24 could be a piece of round-section material, such as a wooden dowel, for example. At each end of the webbing 22, a D-ring 26 is secured for attachment to the bag of a shoulder strap (not shown). Also at each end of the webbing 22 a short length of smaller strapping 28 extends downwardly across the fold portion of the bag and carries another D-ring 30 for a purpose yet to be explained. At each side of the stiffening spine 24, the bag 10 includes flexible portions 32 extending from side to side of the bag and allowing the bag to be folded double on itself as depicted. Outwardly of each leg 14, 16, the bag 10 also includes outer pockets generally referenced with the numeral 33.

Importantly, the bag 10 at each end includes an upper 34 and a lower 36 flexible strap assembly extending between the legs 14, 16 of the bag. In other words, the garment bag 10 includes two pair of the strap assemblies 34 and 36, for a total of four such strap assemblies. As is best seen viewing FIG. 2, these strap assemblies 34, 36 each include a loop 38 of strap material secured to one of the legs 16, and a length 40 of the strap material secured to and extending from the other leg 14. A receiver portion 42 of a two part buckle assembly 44 is secured to the loop 38. The length of strap material 40 is cinched through a tongue portion 46 of the buckle assembly 44 with a free end 48 of this strap material extending outwardly to allow the length of the strap assemblies 34, 36 to be shortened by pulling thereon. The receiver portion 42 and tongue portion 46 of the strap assemblies 34, 36 interlock and are separable to allow the bag 10 to be opened.

Viewing now FIG. 2 more particularly, it is seen that the bag 10 includes a pair of rigid wall portions 50. The pockets 33 have been omitted from the illustration of FIG. 2 to better depict the location and function of the wall portions 50. These wall portions 50 extend from side to side and from top to bottom of each leg 14, 16 of the bag 10 to define an area. That is, the rigid wall portions 50 each have a size or extent which will be seen to be substantially one-half of the length of the open garment bag 10. In FIG. 1, the area of one of the rigid wall portions 50 in leg 16 is enclosed by a dashed line. The other leg 14 similarly includes a rigid wall portion 50 which is not seen in FIG. 1 but which is congruent with the dashed outline seen in this FIG. As is best seen in FIG. 2, these rigid wall portions 50 are spaced apart to define a volume (referenced with the numeral 52) therebetween. As will be further explained, the volume 52 may be packed with clothing, and the strap assemblies 34, 36 may be employed to apply a tension force to the rigid wall portions 50, as is depicted with the arrows 54 on FIG. 2.

Still viewing FIG. 2, it is seen that the bag 10 includes a fitting 56 at the bottom of the one leg 14. A chain 58 with a hook 60 extends from the fitting 56. As will be explained, the bag 10 may be opened and hung by the hook 60 with the leg 14 uppermost and the leg 16 dependent therefrom to allow access into the interior of the bag. Also viewing FIG. 2, an elongate toiletries kit 62 is seen within the bag 10 at the fold thereof. That is, the bag 10 is folded about this toiletries kit 62. The toiletries kit 62 at each end thereof includes a snap fitting 64 which is removably engageable with the respective D-ring 30 to dispose the kit 62 high up into the fold portion 18 of the bag 10. The importance of this toiletries kit and its shape and location will be further explained.

Viewing now FIG. 3, the garment bag 10 is shown nearly in its open configuration preparatory to its being hung by the hook 60 from a closet rod or top edge of a door, for example. In this configuration, the strap assemblies 34, 36 have been separated at the buckle assemblies 44, and a curtain member 66 (seen in FIG. 5) has been removed from the bag to open a chamber 68 therein. As is easily understood, the chamber 68 is defined cooperatively by an outer wall portion 70, the inner surface 72 of which is seen within the bag 10, and the outer surface 74 of which is seen in FIG. 1. This outer wall portion 70 is stiffened at the spine 24, and at the areas of the rigid wall portions 50, so that this wall is only flexible at the flexible portions 32. A flexible peripheral wall portion 76 circumscribes the outer wall portion 70, and extends generally perpendicularly thereto to define a recess referenced with the numeral 78, and having an opening 80. It is seen in FIG. 3 that the rigid wall portions 50 each have a size or extent of substantially one-half of the recess 78 in the length direction of this recess. When the garment bag 10 is hung by the hook 60, the wall 70 straightens so that the wall portions 50 are in substantial alignment.

A lower wall portion 82 spans the bag from side to side at the bottom of the leg 16 and secures to the peripheral wall portion 76 to define a well 84. This lower wall portion 82 carries a pair of quarter-turn fasteners 86, and the peripheral wall portion 76 carries a double-ended zipper 88 at the opening 80. Consequently, when the curtain member 66 is zipped to the peripheral wall 76 at a matching peripheral zipper 90 thereof (viewing FIG. 5), and a pair of grommets 92 of this curtain member are secured onto the quarter-turn fasteners 86, the curtain member closes recess 78 to bound chamber 68 including the well 84, and the volume 52.

Still viewing FIG. 3, it is seen that within the recess 78, the bag 10 includes an upper pair and a lower pair of triangular and flexible fabric wall or wing portions, 94 and 96, respectively. Preferably, these flexible wing portions 94, 96 include central panels 94', 96' of mesh fabric, although this mesh material is not essential to successful practice of the invention. Importantly, these flexible wall portions secure into the recess 78 adjacent the intersection of the outer wall 70 and the peripheral wall 76. That is, the flexible wall portions 94 and 96 each extend across the recess 78 from adjacent the edges of the rigid wall portions 50. Additionally, these flexible fabric wall portions 94, 96 each carry a respective length 98 of a hook and loop fastener, best seen on the lower pair 96, and by which these wall portions may be adjustably secured to one another.

FIG. 3 also shows that the bag 10 includes a pair of hanger support assemblies 100 at the top of the leg 14. These hanger support assemblies 100 secure to the hook 60 via the chain 58 and fitting 56, as well as an intermediate stiffener plate (not shown) which is in the adjacent part of the peripheral wall 76 and allows the entire garment bag 10 to depend from this hook 60.

Turning now to FIG. 4, it is seen that the outer wall 70 includes an inner layer of fabric 102 which defines the inner surface 72 for this wall. Also the outer wall includes the outer layer 104 of flexible, durable and soil-resistant fabric which defines the outer surface 74 for this wall. Between these layers of fabric 102, 104, the outer wall includes a layer or sheet 106 of corrugated or extruded light-weight and shape-retaining (although somewhat flexible) plastic material, which defines the rigid wall portion 50. While the rigid wall portion 50 may be formed of a variety of materials, such as thin plywood, or sheet metal with stiffening creases therein, the extruded plastic material 106 has been found to be both advantageously light in weight and at the same time sufficiently stiff and durable.

An exemplary extruded plastic sheet material is available as corrugated polypropylene copolymer or high-density polyethylene under the name Core-X, from Primex Plastics Corp., 1235 North F Street, Richmond, Ind. The material 106 is of 4 mm thickness and has proven to have adequate strength and rigidity at a very light weight.

As depicted in FIG. 4, the fins, stiffening ribs, or corrugations of the material 106 extend from side to side of the bag 10. This direction of the fins of material 106 is indicated on FIG. 2 with a double-headed arrow referenced with the numeral 106'. It will be understood that the material 106 because of the direction of the fins, ribs, or corrugations therein displays a direction of greatest stiffness, indicated by the arrow 106', and that the material is not quite so stiff (although still shape-retaining) in a perpendicular direction. Accordingly, the rigid wall portion 50 will display a slightly greater stiffness along the extension of the corrugations in the sheet 106 than at right angles to these corrugations. Because the strap assemblies 34 and 36 are disposed adjacent to edges of the wall portion 50 in line with this direction of greater stiffness for the sheet 106, the wall portion 50 distributes the compression forces 54 provided by the strap assemblies 34 and 36 substantially over the areas of the wall portions 50. That is, the volume 52 is substantially uniformly subjected to the compression force from these strap assemblies so that clothing items therein cannot jostle about during transit of the garment bag 10.

However, it is apparent that two sheets of corrugated sheet material may be disposed adjacent to one another with the corrugations of each at ninety degrees to the other, and can possibly be laminated together to form each rigid wall portion 50. These two sheets of material may preferably be thinner than the single sheet 106 so that their combined thickness is about the same. However, in this latter case, the wall portions 50 would then display essentially the same degree of stiffness in each direction.

In order to complete the description of the curtain member 66 seen in FIG. 5, it is important to note that this curtain member includes a transverse pocket 108 into which is received an elongate rod member 110. Securing to the rod member 110 is a short chain and hook assembly 112 by which the curtain member may be suspended. This curtain member 66 defines a plurality of zippered pockets, generally referenced with the numeral 114, and into which a user of the garment bag 10 may pack additional belongings.

Turning now to FIGS. 6 and 7 in conjunction, the toiletries kit 62 is seen to include an elongate chambered body 116 formed of flexible fabric walls 118. The walls 118 define a chamber 120 into which belongings may be packed by means of a zippered opening 122. Importantly, as the sectional view of FIG. 7 illustrates, the body 116 is slightly wider at the top and is tapered downwardly to form a rounded shape in section.

In use of the garment bag 10, a user thereof would open the bag to the position depicted generally by FIG. 3, with the flexible wings 94, 96 opened to allow hanging clothes on hangers to be suspended in the 78 recess from the hanger supports 100. The bottom parts of long clothing items hang into the well 84. After the clothing items are carefully arranged in the recess 78, the flexible wings 94, 96 are secured together across the clothing items with the hook and loop fasteners 98. Thereafter, the curtain member 66 is zipped into place at the opening 80 with zipper portions 88, 90. This curtain member 66 is also secured to the remainder of the garment bag 10 by fitting the quarter-turn fasteners 86 into grommets 92 to complete closure of the chamber 68.

Outwardly of the chamber 68, along a line connecting the D-rings 30 as seen in FIG. 3, the toiletries kit 62 is next secured with the snap fittings 64. Subsequently, the bag 10 is doubled on itself to bring the leg 16 into congruence with the leg 14, as is depicted in FIG. 2. This folding step may be performed while the bag 10 is suspended, or after it has been lain on a horizontal surface, such as a bed somewhat as depicted by FIG. 2. In either case, the flexible wings snugly hold the clothing items in the chamber 68 so that they will shift only minimally, thus reducing wrinkling at this step. Also, the toiletries kit 62 with its generally rounded shape forms a rather large fold-around radius for the bag and clothing items therein. Consequently, the clothing items do not crease or wrinkle at the fold portion 18 of the bag 10.

Next, the buckle assemblies 44 are engaged to connect the straps 34, 36 between the legs 14 and 16 of the bag. Finally, the strap assemblies 34, 36 are tightened by pulling on the free end 48. This tightening step applies the forces depicted by arrows 54 seen on FIG. 2, and substantially immobilizes the clothing items in the volume 52. That is, the rigidity of the wall portions 50, which in the depicted exemplary embodiment of the invention is provided by the extruded plastic sheet material 106, distributes the forces 54 over the area of the rigid wall portions. Also, because the outer pockets 33 are outside of and overlie the panels 50, when these pockets are packed with clothing and other items they assist in supporting these panels. Also, the presence of the pockets 33 outwardly of the panels 50 contributes to protecting these panels from physical damage in the event the bag 10 is subjected to rough handling.

In addition to the advantages derived from immobilizing clothing items in the volume 52, the stiffness provided by the rigid wall portions 50 allows the bag 10 to better stand up by itself much as is seen in FIG. 1. Unlike most garment bags, which are only able to support themselves in an upright position when they are packed very full of clothes, the garment bag 10 will stand upright even when empty. This self-standing feature makes the bag 10 much more convenient to carry as the bag does not flop to the floor with its handle out of reach every time it is set down. The rigid wall portions 50 also provide additional protection for items which might be damaged in handling of the garment bag 10.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

What is claimed is:

1. A garment bag of the type including an elongate body formed substantially of flexible fabric or sheet material, said body in a first open position thereof defining an elongate vertically extending recess having a hanger support member at a top thereof and into which clothing items are receivable on hangers to depend from said hanger support member, said body folding on itself along with said clothing items in said recess to a second closed position to define a chamber of generally U-shape, and said body including a pair of substantially rigid wall portions of rectangular shape disposed on opposite sides of said chamber and extending substantially from side to side and top to bottom of said chamber to sandwich said clothing items therebetween so as to substantially uniformally apply a compressive force to said clothing items, said garment bag further including a first upper pair and a second lower pair of adjustable-length strap members each extending between said pair of wall portions adjacent respective corners thereof; further including at least a pair of flexible wing members disposed in said recess and closing cooperatively across said clothing items, said pair of wing members including means for adjustably securing to one another and snugly securing said clothing items in said recess in substantial immobilized relation with one of said pair of rigid wall portions during movement of said body between said first and said second positions.

2. A garment bag comprising an elongate body portion substantially formed of flexible fabric or sheet material, said body portion in a first open position thereof defining an elongate vertically extending recess having a hanger support member at a top thereof and into which clothing items are receivable on hangers to depend from said hanger support member, said body portion folding on itself along with said clothing items in said recess to a second closed position to define a chamber of generally U-shape, said body portion further including a pair of opposed variably spaced apart and substantially planar wall portions which are substantially rigid along mutually perpendicular directions in the plane of said wall portions over a majority of the extent of said garment bag chamber and which wall portions are disposed on opposite sides of said chamber, said garment bag further including means cooperating with said wall portions for urging the latter toward one another, whereby said wall portions forcefully sandwich clothing items therebetween to immobilize said clothing items in said chamber, an outer wall including said rigid wall portions and at least one flexible portion allowing said garment bag to fold on itself, and a flexible peripheral wall portion extending substantially perpendicularly from said outer wall and cooperating therewith to define said recess, said peripheral wall portion defining an opening to said chamber, a curtain member to close said opening, and means for removably securing said curtain member to said peripheral wall portion.

3. The garment bag of claim 2 wherein said curtain member includes means for defining at least one pocket therein.

4. The garment bag of claim 3 wherein said curtain member further includes hook means for suspending said curtain member.

5. The garment bag of claim 2 wherein said garment bag further includes at least a pair of flexible wing members disposed in said recess adjacent opposite sides of one of said pair of wall portions and means for adjustably connecting said pair of wing members to one another so that said pair of wing members adjustably hug clothing items in said recess into substantially immobilized relation with said one wall portion of said pair of rigid wall portions.

6. The garment bag of claim 5 wherein said flexible wing members include a panel of mesh material.

7. A garment bag comprising an elongate body portion substantially formed of flexible fabric or sheet material, said body portion in a first open position thereof defining an elongate vertically extending recess having a hanger support member at a top thereof and into which clothing items are receivable on hangers to depend from said hanger support member, said body portion folding on itself along with said clothing items in said recess to a second closed position to define a chamber of generally U-shape, said body portion further including a pair of opposed variably spaced apart and substantially planar wall portions which are substantially rigid along mutually perpendicular directions in the plane of said wall portions over a majority of the extent of said garment bag chamber and which wall portions are disposed on opposite sides of said chamber, said garment bag further including means cooperating with said wall portions for urging the latter toward one another, whereby said wall portions forcefully sandwich clothing items therebetween to immobilize said clothing items in said chamber, an outer wall including said rigid wall portions and at least one flexible portion allowing said garment bag to fold on itself, and a flexible peripheral wall portion extending substantially perpendicularly from said outer wall and cooperating therewith to define said recess, said peripheral wall portion defining an opening to said chamber, a curtain member to close said opening, and means for allowing said curtain member to be manually moved between a first position closing said opening to said chamber and a second position opening said chamber to allow clothing items to be passed through said opening.

* * * * *